US010957287B2

(12) United States Patent
Conner, II

(10) Patent No.: US 10,957,287 B2
(45) Date of Patent: Mar. 23, 2021

(54) APPARATUS FOR CREATING CUSTOMIZED DRUM SET

(71) Applicant: Hey 9, Inc., Kirtland, OH (US)

(72) Inventor: Larry W. Conner, II, Kirtland, OH (US)

(73) Assignee: Hey 9, Inc., Kirtland, OH (US)

( * ) Notice: Subject to any disclaimer, the term of this patent is extended or adjusted under 35 U.S.C. 154(b) by 135 days.

(21) Appl. No.: 16/003,169

(22) Filed: Jun. 8, 2018

(65) Prior Publication Data

US 2018/0357987 A1 Dec. 13, 2018

Related U.S. Application Data

(60) Provisional application No. 62/603,671, filed on Jun. 9, 2017.

(51) Int. Cl.

| | |
|---|---|
| ***G10D 13/02*** | (2020.01) |
| ***G10D 3/16*** | (2020.01) |
| ***G10D 13/10*** | (2020.01) |
| ***G10D 13/16*** | (2020.01) |

(52) U.S. Cl.

CPC ..... *G10D 13/02* (2013.01); *G10D 13/10* (2020.02); *G10D 13/16* (2020.02); *G10D 13/28* (2020.02)

(58) Field of Classification Search

CPC ... G10D 13/023; G10D 13/021; G10D 13/026
USPC ..... 84/413
See application file for complete search history.

(56) References Cited

U.S. PATENT DOCUMENTS

| | | | | |
|---|---|---|---|---|
| 910,659 | A * | 1/1909 | Ford | A47F 7/283 211/85.26 |
| 5,520,292 | A * | 5/1996 | Lombardi | A47F 7/00 211/182 |
| D410,805 | S * | 6/1999 | Ludviksson | D6/682.6 |
| 7,506,771 | B2 * | 3/2009 | Bianchini | A47B 73/00 211/75 |
| 8,167,148 | B2 * | 5/2012 | Jacobson | A47B 81/00 108/193 |
| 8,263,847 | B2 * | 9/2012 | Saravis | G10D 13/02 84/411 R |
| 9,449,588 | B2 | 9/2016 | Verderosa | |

* cited by examiner

*Primary Examiner* — Jianchun Qin
(74) *Attorney, Agent, or Firm* — Calfee, Halter & Griswold LLP

(57) ABSTRACT

Exemplary embodiment for customizable drum sets for creating a drum set out of household items are disclosed herein. An exemplary drum set includes a frame, two or more holder sections, a first retaining member located within each holder section and a second retaining member located within each holder section. The drum set further includes at least one guide member and the first retaining member is movable along the guide member in a linear direction. A tensioner for causing the first retaining member to be biased towards the second retaining member is also included. The first retaining member and the second retaining member are configured to releasably secure a household item therebetween.

13 Claims, 3 Drawing Sheets

APPARATUS FOR CREATING CUSTOMIZED DRUM SET

RELATED APPLICATIONS

This application claims the benefits of, and priority to, U.S. Provisional Patent Application No. 62/603,671, titled Apparatus for Selectively Receiving and Securing Objects, which was filed on Jun. 9, 2017 and which is incorporated by reference herein in its entirety.

FIELD OF THE INVENTION

The invention relates to drum sets and more particularly to an apparatus for creating a customized drum set.

BACKGROUND

Percussion instruments are believed to be the oldest family of musical instruments after the human voice. A percussion instrument is defined as an instrument made of sonorous material. Vibrations in the sonorous material produce sounds of definite or indefinite pitch when shaken or struck.

It is believed that percussion instruments have existed since before 6000 B.C. The first types of percussion instruments were drums consisting simply of any object struck by other object (including human hands) to produce sound. For as long as people have understood that striking an object produces sound, they have been creating improvised percussion instruments (from hitting two sticks together to drumming on their desks with pencils, and including untold number of other combinations).

Household items are commonly repurposed as drums. Kitchen pots and pans, struck by wooden spoons, are a well-known example (see, for instance, the lyrics to "Shake, Rattle and Roll," written and first recorded in 1954, which state in relevant part, " . . . get in that kitchen, make some noise with the pots and pans . . . "). Recyclable items—coffee cans, milk jugs, plastic bottles, cardboard boxes, among many others—and other goods like inflatable balls. pillows and cushions are often conscripted into use as drums.

SUMMARY

Exemplary embodiments for customizable drum sets that may be used for creating a drum set out of household items are disclosed herein. An exemplary drum set includes a frame, two or more holder sections, a first retaining member located within each holder section and a second retaining member located within each holder section. The drum set further includes at least one guide member. The first retaining member is movable along the guide member in a linear direction. A tensioner for causing the first retaining member to be biased towards the second retaining member is also included. The first retaining member and the second retaining member are configured to releasably secure a household item therebetween.

Another exemplary embodiment of a customizable drum set for retaining drums made of household items includes a frame, two or more holder sections, a first moveable retaining member located within each holder section, a second movable retaining member located within each holder section and at least one guide. The first movable retaining member and second movable retaining member are movable along the guide in a linear direction. A tensioner for causing the first retaining member and the second retaining member to be biased toward one on other and a centering member configured to move the first and second moveable retaining members toward the center of the holder section are also included. The first retaining member and the second retaining member are configured to releasably secure a household item therebetween.

Another exemplary embodiment of a customizable drum set for retaining drums made of household items includes a frame, a first holder section, a first surface in the first holder section, a first aperture located in the first surface and a first mating object configured to fit at least partially in the first aperture. In addition, the drum set includes a second holder section, a second surface in the second holder section, a second aperture located in the second surface and a second mating object configured to fit at least partially in the second aperture.

BRIEF DESCRIPTION OF THE DRAWINGS

These and other features and advantages of the present invention will become better understood with regard to the following description and accompanying drawings in which.

DETAILED DESCRIPTION

Figure 1:
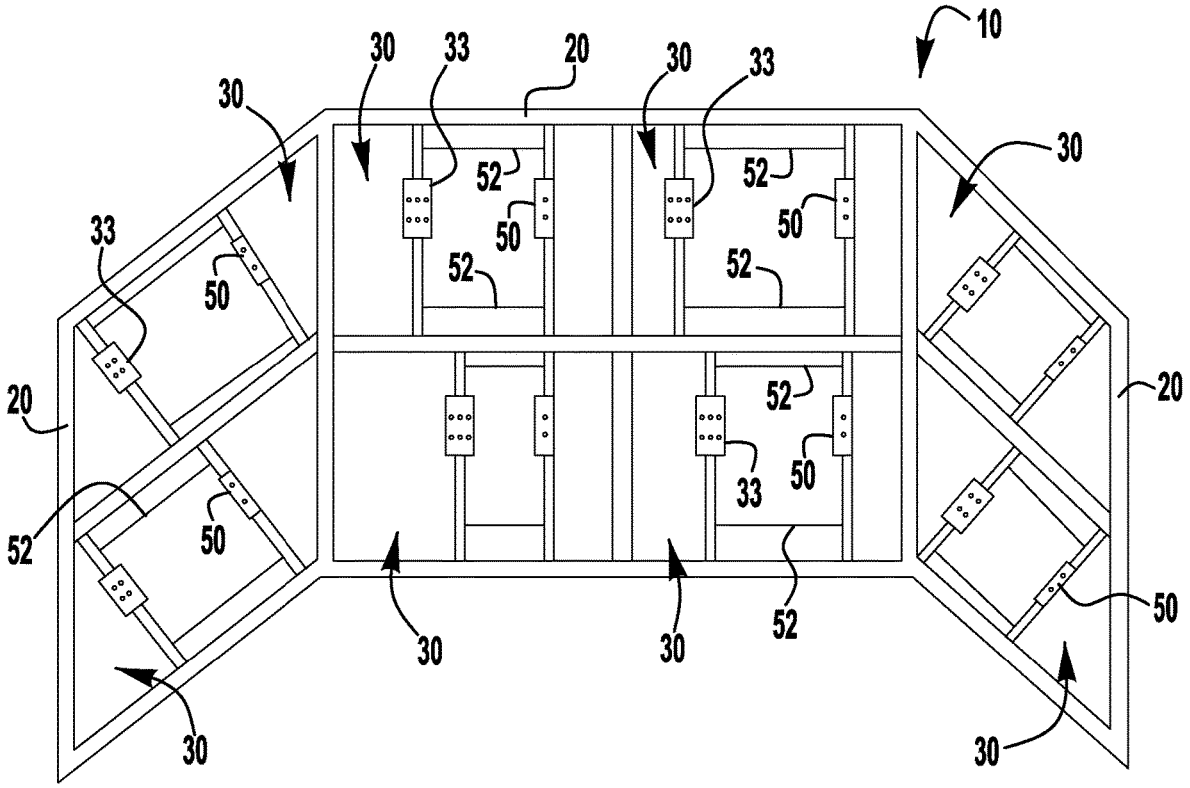
FIG. 1 is a plan view of an exemplary embodiment of a drum kit.

The Detailed Description describes exemplary embodiments of the invention and is not intended to limit the scope of the claims in any way. Indeed, the invention is broader than and unlimited by the exemplary embodiments, and the terms used in the claims have their full ordinary meaning, unless otherwise noted herein.

The exemplary embodiments described herein provide apparatuses for securely, but temporarily, retaining multiple household items in a manner that they may be used together as a drum set (most drum kits or drum sets have at least three pieces, a snare drum, tom-tom, and bass drum; drum sets can be much, much larger). Exemplary embodiments of the drum set may hold, for example, plastic bottles. Plastic bottles are excellent at producing drum sounds and are lightweight (and typically round). Striking them if they are not secured often results in the bottle being knocked away from a drummer. Inflatable balls similarly tend to roll away when struck if they are not secured. The exemplary embodiments of drum sets disclosed herein, overcome these deficiencies and secure such household items in place for use as percussion instruments.

In addition, the exemplary embodiments of drum sets disclosed herein facilitate exploration of a drummer's environment (with the drummer here envisioned to be a child, but the inventive concepts could be enjoyed by people of any age) to see what sorts of objects make good drums, and what combinations of objects sound good together when assembled as a drum set. Repurposing items helps to stir creativity and improvisation, and is useful in developing problem solving skills.

In the exemplary embodiments described herein, assembling a drum set is easy and does not require outside or additional tools or fasteners. Furthermore, the exemplary embodiments create a sturdy drum set that can withstand vigorous drumming. In addition, the drum set is compact while not in use. Unlike a "real" drum kit which takes up significant space (in all three dimensions), the objects utilized in the exemplary embodiments can be returned to the recycle bin where they were found, thrown away, or if with household items, such as, for example, balls or pots and pans, they may be returned to their proper storage place.

In some exemplary embodiments, when the drum set is not in use, it folds substantially flat, or easily breaks down and can be stored under a bed or in the back of a closet. In this configuration, it takes up relatively little space. In some exemplary embodiments, the drum set has legs so that the user can stand or sit on a chair/stool to utilize it. In some embodiments, the drum set does not have legs and may be set on a desk, table or counter. In some embodiments, the drum set includes a carrier so that it may be used like real drums found in marching bands (often known as "quad drums" or "marching tenor drums").

Although many exemplary embodiments disclosed herein are designed to be used with household items (or really, any objects made of sonorous materials the user can obtain, within size limitations) as drums, in one embodiment, actual drum heads designed specifically for this invention can be utilized. In some exemplary embodiments, the drum heads store inside themselves like Russian nesting dolls to take up as little space as possible when not in use. In addition, in some embodiments, pre-existing drum heads commercially available today can also be utilized in the invention.

FIG. 1 is an exemplary embodiment of a drum set 10. The exemplary drum set 10 includes a frame 20 that includes eight holder sections 30. In some exemplary embodiments, there are more than eight holder sections 30, such as, for example, 9 holder sections 30, 10 holder sections 30, or more holder sections 30. In some exemplary embodiments, there are less than eight holder sections 30, such as, for example, six holder sections 30, five holder sections 30, four holder sections 30, three holder sections 30 or two holder sections 30.

In addition, although exemplary embodiments show the holder sections 30 on a single plane, various holder sections 30 may be located on different planes, such as, for example, holder sections 30 that are located further away from the drummer may be at a higher elevation than holder sections 30 closer to the drummer. Similarly, holder sections to the sides of the drummer may be at a higher elevation than holder sections 30 located in front of the drummer. In addition, in some embodiments, multiple holder sections 30 may be located above one another. Further, some holder sections 30 may be at an angle that rises as it moves away from the drummer.

In some embodiments, the frame 20 is constructed to have different "built in" sonorous elements. For instance, the frame 20 can have holes, or sections with different sized hollow volumes. In addition, in some embodiments, frame 20 can have raised ridges or serrations similar to a guiro for different acoustic effects.

In some embodiments, frame 20 can also have a holder section 30 located at floor/ground level made to hold an object (not shown) to serve as a kick-drum or bass drum. In one embodiment, the frame includes a vertical rack (not shown) that extends upward from the frame 20, and which has connectors and/or hooks or upon which objects could be hung to be struck similar to a bell or a cymbal.

In this exemplary embodiment, each holder section includes a stationary retaining member 50 and a movable retaining member 33. In some embodiments, stationary retaining member 50 may be formed at least in part by frame 20.

Stationary retaining member 50 and movable retaining member 33 may take many forms. In some exemplary embodiment, one or both of the stationary retaining member 50 and movable retaining member 33 include a surface treatment (not shown) to help in securing a household item (not shown). The surface treatment may be done to the surface of the movable retaining member 33, the stationary retaining member 50 or may be added to the surface of one or both of the retaining members 33, 50. In some embodiments, a rubber (not shown) surface treatment or the like is used to create additional friction for holding the household item. In some embodiments, a textured surface treatment (not shown) is used. In some embodiments a textured surface includes a plurality of projections. In some embodiments, the textured surface treatment comprises one of plastic, rubber, polymer, metal, or combinations thereof.

Figure 3:
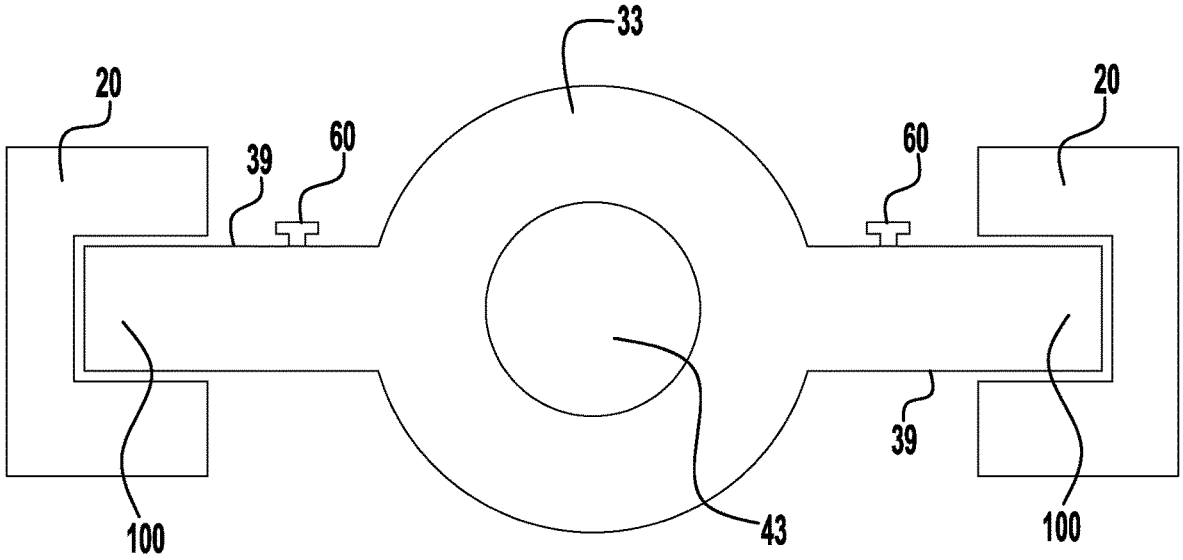
FIG. 3 is a cross-sectional view of a portion of a retaining member located in a holder section.

In some embodiments, one or both the movable retaining member 33 and the stationary retaining member 50 include an aperture 43 (FIG. 3). In this exemplary embodiment, aperture 43 is round, however one or more other geometric shapes may be used, such as, for example, square, star shaped, trapezoidal, and the like. In some embodiments, movable retaining member 33 and/or stationary retaining member 50 include two or more apertures 43 to aid in retaining various household items. Exemplary household items include, for example, bottles, jugs, plates, glasses, boxes, balls, toys, tubes, metal cans, rubber balls, frisbees, records, dinner plates, and the like.

The moveable retaining member 33 and the stationary retaining member 50 are shown as being substantially flat, however, the moveable retaining member 33 and the stationary retaining member 50 could take almost any shape. In some embodiments the moveable retaining member 33 and the stationary retaining member 50 have curved portions (not shown) that are beneficial for holding rounded objects. The moveable retaining member 33 and the stationary retaining member 50 can also vary in length, provided that they still fit within the holder sections 30.

Figure 2:
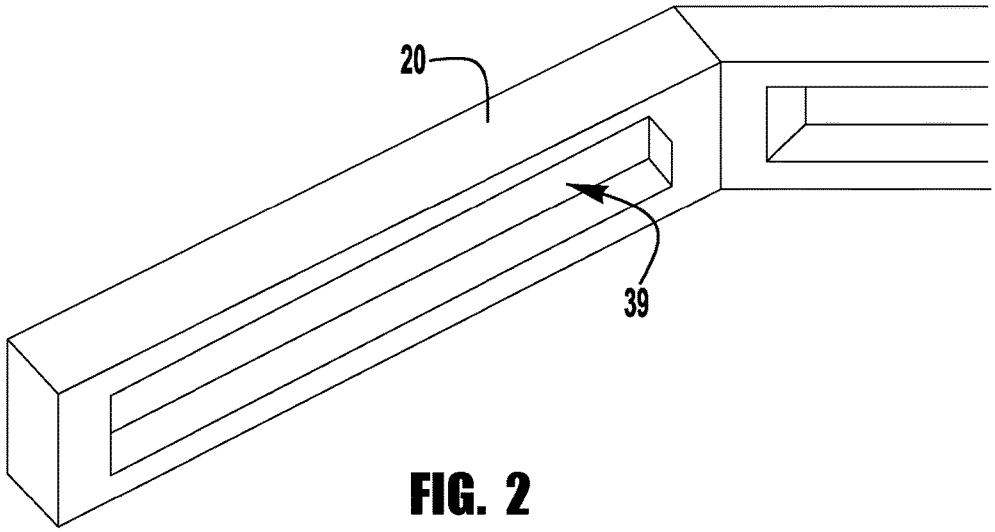
FIG. 2 is a prospective view of a portion of an exemplary holder section for holding a drum of the drum kit.

In some embodiments, frame 20 includes a plurality of guides 39 as shown in FIG. 2. Guides 39 allow movable retaining member 33 to move away from stationary retaining member 50 to allow a household item to fit between movable retaining member 33 and stationary retaining member 50. In some exemplary embodiments, movable retaining member 33 includes extension arms 100. Extension arms 100 are configured to fit within guides 39, which allow moveable retaining member 33 to move back and forth in a linear direction. In some embodiments, frame or extension arms 100 include one or more retainers (not shown) that slidably secure moveable retaining member 33 to frame 20.

Holder sections 30 include one or more tensioners 52. Tensioners 52 are used to apply pressure to the household item (not shown) to aid in retaining the household item in place. In some exemplary embodiments, tensioners 52 are elastomeric members, such as for example, rubber bands. Moving the movable retaining member 50 away from the stationary retaining member 50 stretches the elastomeric member and results in clamping pressure between the retaining member 33 and stationary retaining member 50 to hold the household item.

In some embodiments, tensioner 52 is a threaded rod (not shown) that mates with threads (not shown) on movable retaining member 33 and rotation of the threaded rod in a first direction moves retaining member 33 away from stationary retaining member 50 and rotation in a second direction causes moveable retaining member 33 to move towards stationary retaining member 50. In some embodiments, tensioner 52 is a rod (not shown) and moveable retaining member 33 includes a clamp (not shown) that may be released to move moveable retaining member 33 and set to lock movable retaining member 33 in place. In some embodiments, tensioner 52 is a threaded rod (not shown) and a threaded disk (not shown) may be located on the side of the moveable retaining member 33 away from the stationary retaining member 50 so that the threaded disk may be rotated to move the movable retaining member 33 toward stationary retaining member 50. Other exemplary types of tensioners include a ratchet and track, a helical clamp-like device, a belt, or strings, ropes, and the like. Tensioners 52 are preferably elastic bands or springs as they make it easy and fast to load and/or change out various household items.

Although the exemplary embodiments are described as having one stationary retaining member 50 and one moveable retaining member 33, in some embodiments, both retaining members are moveable. In some embodiments, movable retaining member 33 includes tensioner anchors 60 (FIG. 3). In this exemplary embodiment, tensioner anchors 60 engage tensioners 52, which may be rubber bands.

The term "tensioner(s)" as used herein is broader than its ordinary meaning and may include compressive force. Accordingly, tensioner as used herein includes necessary structure to cause a force between two or more retaining members that aids in retaining an object, such as, for example, a household item in place.

In some embodiments, tensioners 52 are replaced with, or used in conjunction with compressive springs (not shown), the compressive springs may be located between the one or more movable retaining members and the frame 20 to push the movable retaining member toward the second retaining member.

Figure 4:
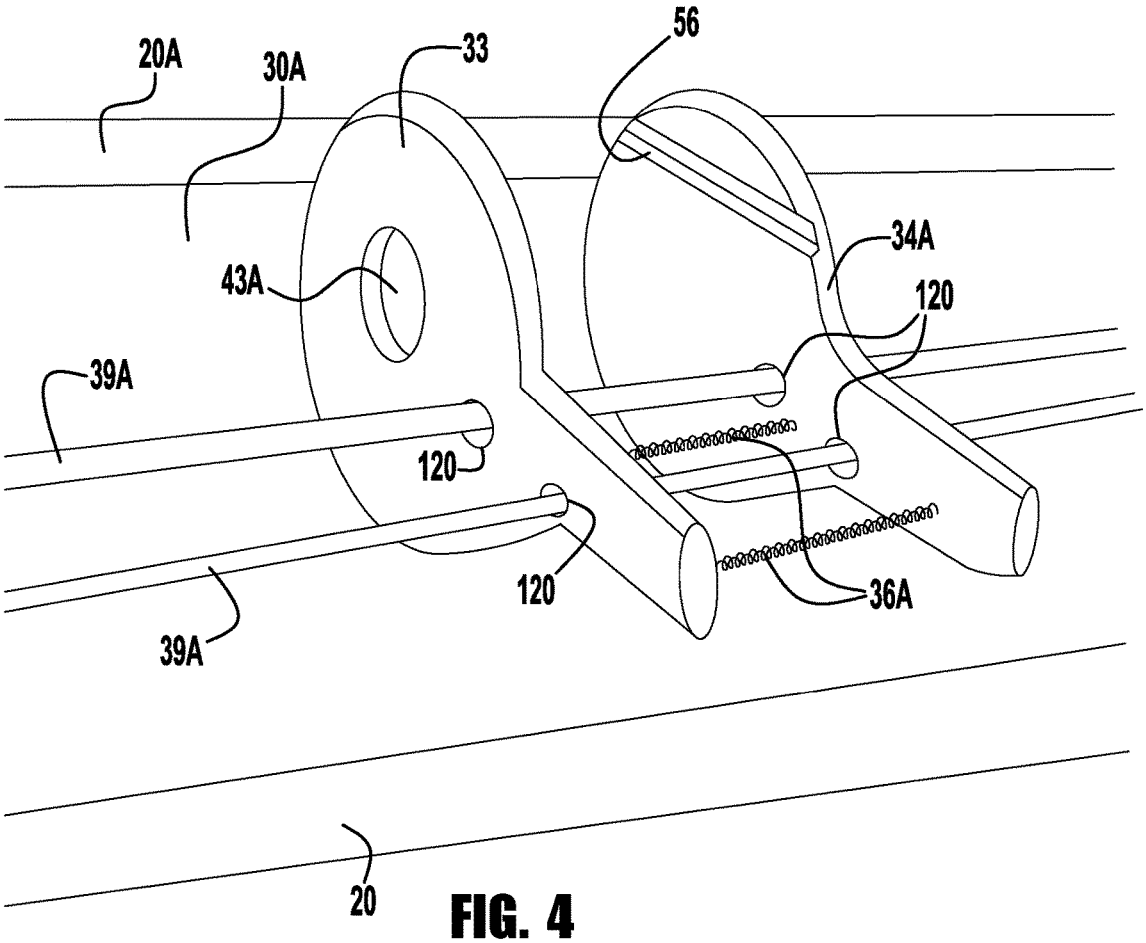
FIG. 4 is a partial prospective view of another exemplary embodiment of a holder section for holding a drum in the drum set.

FIG. 4 illustrates another exemplary embodiment of a holder section 30A. Holder section 30A includes frame members 20A, guide rails 39A, and movable retaining members 33A, 34A. Moveable retaining members 33A, 34A include apertures 120. Guides 39A fit through apertures 120 and allow retaining members 33A, 34A to move back and forth in a linear direction. In some embodiments, apertures 120 in one of the members are sized to prevent movement of one of the retaining members. In some embodiments, a clamp member (not shown) may be used to prevent movement of one retaining members.

Holder section 30A includes tensioners 36A between first retaining member 22A and second retaining member 34A, which in this exemplary embodiment, are elastomeric members. Moveable retaining member 33A includes an aperture 43A. As described above, aperture 43A may have any geometric shape and may be sized based upon typical household items, such as for example, based on the diameter of a neck of a typical bottle or container. Movable retaining member 34A includes surface treatment 50A. Surface treatment 50A is a groove extending along its length of the member. As described above, surface treatment 50A may be any type of surface treatment that helps retain the household item. In addition, in some embodiments groove 50A is sized to receive a specific drum head and retain it in place.

In some embodiments, the movable retaining members 33A, 34B are configured to be self-center within the space defined for each holder section 30A by the Frame 20A. In some embodiments, this may be accomplished by use of opposing tensioners (not shown), such as, for example, springs connected between the retaining members 33A, 34A and the frame 20A.

Figure 5:
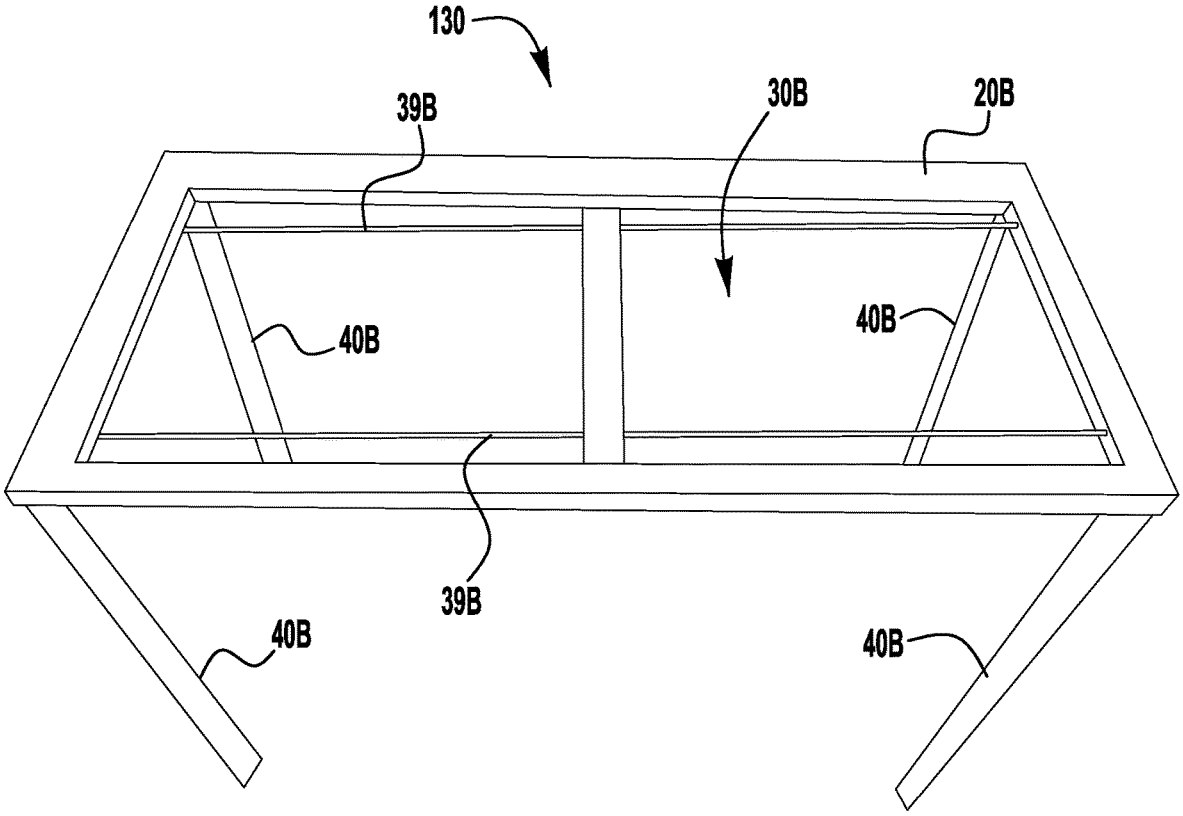
FIG. 5 is a prospective view of a drum set having two holder sections without showing retaining members or tensioners.

FIG. 5 is a prospective view of an exemplary drum set 130 having two holder sections 30B (without showing the retention members or tensioners). Drum set 130 is a two-section drum set, however as described above, it may have more or less sections. Drum set 130 includes frame members 20B that include guides 39B that are similar to frame members 20 and guides 39. In addition, drum set 130 includes legs 40B. Legs 40B are hingedly attached to frame 20B and may be folded down to store the drum set in a compact fashion. In some embodiments, the legs 40B are telescoping and may be extended out during use. In some embodiments, the legs 40B are removable.

Figure 6:
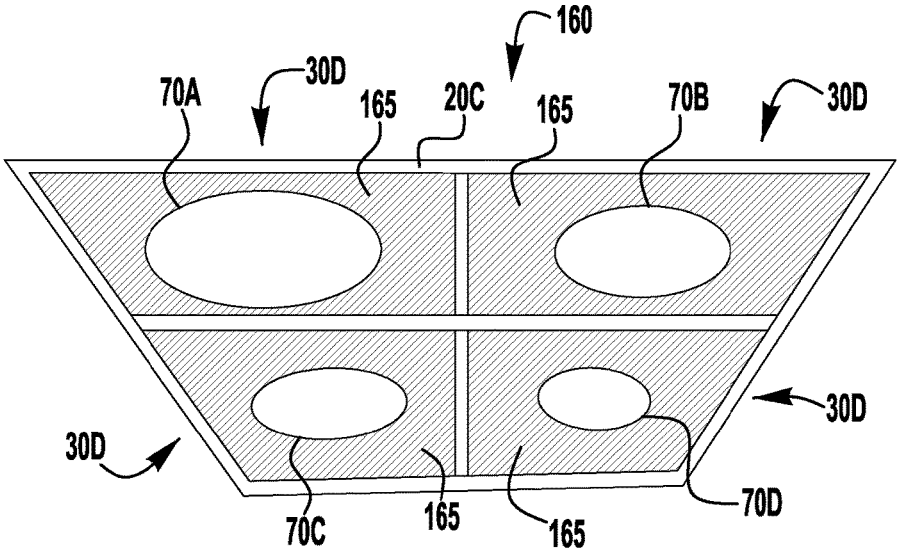
FIG. 6 is a plan view of another exemplary embodiment of drum set.

FIG. 6 is a plan view of another exemplary embodiment of drum set 160. In this exemplary embodiment, drum set 160 includes frame 20C. Frame 20C includes four holder sections 30D. Each holder section 30D includes a surface 165. In each surface 165 is an aperture 70A, 70B, 70C and 70D respectively. Apertures 70A, 70B, 70C and 70D are configured to receive an object that serves as a drum. In some embodiments, the apertures 70A, 70B, 70C and 70D are sized so that each one corresponds to a size of a type of household item and can receive and secure that type of item. Such as, for example, aperture 70A may be sized to receive a standard size ball (not shown), aperture 70B may be sized to receive a standard 2-liter bottle (not shown), aperture 70C may be sized to receive a 2-gallon milk container (not shown) and aperture 70D may be sized to receive a pan (not shown).

In some embodiments, apertures 70A, 70B, 70C and 70D are sized to receive a mating object (not shown) that is supplied with the drum set 160. In some embodiments, the mating object (not shown) has a body portion that is inserted through the aperture and one or more projections that do not fit through the aperture, and secure the mating object in the aperture 70A, 70B, 70C and 70D. To remove the mating object from the aperture 70A, 70B, 70C and 70D, it is pressed upward from below the Frame 20C, it slides out of the aperture 70A, 70B, 70C and 70D and out of holder section 30D.

In some embodiments, each aperture 70A, 70B, 70C and 70D has a different diameter or geometry and accordingly each mating object (not shown) may have a different outside diameter or geometry. This allows the mating objects (in the shape of, for example, buckets or traditional drums) to fit within each other for convenient storage.

In some embodiments, the larger mating object (not shown) includes a lid, which may be hinged to the mating object, connected with a friction fit, or the like, and forms a sealed container retaining all the mating objects. In some embodiments, the outside of the outermost mating object (not shown) could have at least one rubber foot (not shown) to keep it from moving when used as a bass drum. The side of the mating object opposite the rubber foot could have a handle, or straps, for convenient carrying.

Utilizing the elements identified above, the exemplary drum set is an apparatus in which a user can insert objects to be held temporarily. In its preferred embodiment, the drum set holds the objects in a substantially planar array.

In some embodiments, during operation of the invention a user grabs an object with one hand; slides the moveable retaining member 33 of a holder section 30 away from the stationary retaining member 50 with the other hand; places an object between the two retaining members; and allows the movable retailing member 33 to move back toward the stationary retaining member 50, which secures the object in place by pressure created by the tensioner 52.

The object can then be removed from the drum set 10 by sliding the movable retaining member 33 away from the stationary retaining member 50, at which point the object is lifted out of the drum set 10. A handle (not shown) could also be affixed to the movable retaining member 33 for added ease of operation.

The drum set can be composed of a variety of materials, such as, for example, ceramics, composites, concrete, glass, metals, polymers/plastics, and wood. Weight, strength, and cost all factor into determining the ideal composition of the invention, but for its overall operability, the invention's composition can be just about anything. In some embodiments, the frame and/or other portions are made using injection molding or 3D or additive printing.

In some embodiments, rather than use household items as the drums, an exemplary embodiment utilizes custom drumheads designed to mate with the moveable retaining member and the stationary retaining member.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A customizable drum set for retaining drums made of household items comprising:

a frame;

two or more holder sections;

a first retaining member located within each holder section;

the first retainer having an aperture therethrough, the aperture configured to receive at least a portion of a household item;

a second retaining member located within each holder section;

at least one guide member;

wherein the first retaining member moves along the at least one guide member separately from the second retaining member;

wherein the first retaining member is movable along the guide member in a linear direction to be positioned with respect to the second retaining member such that the first retaining member remains substantially parallel to the second retaining member while the first retaining member is moved proximate the second retaining member;

a tensioner for causing the first retaining member to be biased towards the second retaining member; and wherein the first retaining member and the second retaining member are configured to releasably secure the household item therebetween; and wherein the household item is positioned such that it forms at least a portion of a drum set.

2. The customizable drum set for retaining drums made of household items of claim 1 wherein the tensioner is one or more elastic bands.

3. The customizable drum set for retaining drums made of household items of claim 1 wherein the tensioner provides a compressive force.

4. The customizable drum set for retaining drums made of household items of claim 1 wherein the at least one of the first retaining member and the second retaining member includes a surface treatment.

5. The customizable drum set for retaining drums made of household items of claim 1 wherein the at least one of the first retaining member and the second retaining member includes a curved surface.

6. The customizable drum set for retaining drums made of household items of claim 1 further comprising an extension member extending upward from the frame, wherein the extension member is configured to provide support for an object at a plane higher than at least one of the holder sections.

7. The customizable drum set for retaining drums made of household items of claim 1 further comprising a second guide member.

8. A customizable drum set for retaining drums made of household items comprising:

a frame;

two or more holder sections;

a first moveable retaining member located within each holder section;

the first moveable retaining member having an aperture configured to receive at least a portion of a household item;

a second movable retaining member located within each holder section;

at least one guide;

wherein the first movable retaining member and second movable retaining member are movable along the guide in a linear direction;

wherein the first movable retaining member and the second movable retaining members move separately from one another;

wherein the first movable retaining member remain substantially parallel to one another as they move along the guide in a linear direction;

a tensioner for causing the first retaining member and the second retaining member to be biased toward one on other;

and a centering member configured to move the first and second moveable retaining members toward the center of the holder section; and wherein the first retaining member and the second retaining member are configured to releasably secure the household item therebetween; and wherein the household item is positioned such that it forms at least a portion of a drum set.

9. The customizable drum set for retaining drums made of household items of claim 8 wherein the tensioner is one or more elastic bands.

10. The customizable drum set for retaining drums made of household items of claim 8 wherein the tensioner provides a compressive force.

11. The customizable drum set for retaining drums made of household items of claim 8 wherein the at least one of the first retaining member and the second retaining member includes an aperture therethrough.

12. The customizable drum set for retaining drums made of household items of claim 8 wherein the at least one of the first retaining member and the second retaining member includes a surface treatment.

13. The customizable drum set for retaining drums made of household items of claim 8 wherein the at least one of the first retaining member and the second retaining member includes a curved surface.

* * * * *